United States Patent [19]

Plammer et al.

[11] Patent Number: 4,479,517

[45] Date of Patent: Oct. 30, 1984

[54] LOW PROFILE CIRCULAR LOOM

[75] Inventors: Alfred Plammer, Seewalchen; Hermann Weiss, Lenzing; Adolf Schachinger; Johann Schönberger, both of Timelkam; Johann Bloo, Rosenau; Bruno Mistlberger, Vöcklabruck, all of Austria

[73] Assignee: Chemiefaser Lenzing Aktiengesellschaft, Lenzing, Austria

[21] Appl. No.: 426,284

[22] Filed: Sep. 29, 1982

[30] Foreign Application Priority Data

Nov. 25, 1981 [AT] Austria ..... 5064/81

[51] Int. Cl.[3] ..... D03D 37/00; D03D 47/26

[52] U.S. Cl. ..... 139/13 R; 139/436

[58] Field of Search ..... 139/13 R, 13 A, 16, 139/436, 84

[56] References Cited

U.S. PATENT DOCUMENTS

| | | | |
|---|---|---|---|
| 951,449 | 3/1910 | Petersen | 139/13 R |
| 1,426,641 | 8/1922 | Hirst . | |
| 1,720,151 | 7/1929 | Séry . | |
| 3,871,413 | 3/1975 | Torii | 139/13 R |
| 3,961,648 | 6/1976 | Torii | 139/13 R |
| 4,365,651 | 12/1982 | Torii | 139/13 A |

FOREIGN PATENT DOCUMENTS

| | | | |
|---|---|---|---|
| 363873 | 9/1981 | Austria . | |
| 805026 | 5/1951 | Fed. Rep. of Germany . | |
| 628795 | 7/1927 | France | 139/13 R |
| 840559 | 1/1939 | France . | |
| 257690 | 4/1949 | Switzerland | 139/13 R |
| 374562 | 6/1932 | United Kingdom | 139/16 |

*Primary Examiner*—James Kee Chi

*Attorney, Agent, or Firm*—Brumbaugh, Graves, Donohue & Raymond

[57] ABSTRACT

In a circular loom a reed and at least one shuttle are arranged between an upper and a lower running ring of a machine frame. A rotor driving the shuttle, a harness arranged in a concentric circle about the rotor for shedding the warp threads, and tensioning means for the warp threads also are provided. A wave-like extending groove is provided in the outer side of the rotor and catch elements engage therein. The catch elements are connected with flexible bands or cords carrying thread guiding organs arranged at a distance from one another. The bands or cords are deflected at least about upper deflection pulleys, the thread guiding organs coming to lie on opposite sides of the deflection pulley and the upper deflection pulley being at the height of the upper running ring. The distance between the upper and the lower running rings, as well as the maximum distance between the thread guiding organs at the deflected flexible band or cord, are dimensioned such that the shedding angle is sufficiently large to prevent a contact of the warp threads with the shuttle.

9 Claims, 16 Drawing Figures

LOW PROFILE CIRCULAR LOOM

BACKGROUND OF THE INVENTION

The invention relates to a circular loom comprising a machine frame including an upper and a lower running ring between which a reed and at least one shuttle are arranged, a rotor driving the shuttle, a harness arranged in a concentric circle about the rotor for shedding the warp threads, and tensioning means for the warp threads.

A circular loom of this kind is known from Austrian Pat. No. 363,873. The warp threads, for the formation of a shed, are guided by means of heddles, two heddles each being connected by a band on their ends. One of the bands is guided over an upper deflection pulley and the opposite band is guided over a lower deflection pulley.

It is a disadvantage of this known arrangement that the heddles necessitate a considerably great overall construction height of the circular loom, in particular an extension beyond the upper running ring. A further disadvantage is, despite the great construction height, the shed is insufficiently opened by the heddles for the passage of the shuttle, so that the shuttle itself must further open a shed when passing the same. The warp threads may thereby heat up due to the resulting friction, which is particularly disadvantageous when weaving synthetic threads. Thus, the production speed and the production output cannot exceed a certain level.

SUMMARY OF THE INVENTION

The invention aims at avoiding these disadvantages and difficulties, and has as an object to provide an improved circular loom of the initially defined kind by which a high production output is feasible. In particular, it is an object of the present invention to provide a low profile circular loom the height of which is determined substantially by the position of the upper running ring, a sufficiently widely opened shed being formed despite this comparatively smaller height than known arrangements so that a shuttle may be guided through the shed without sliding contact with the warp threads.

This object is achieved according to the invention by the combination of the following characteristic features:

(a) The harness comprises a wave-like extending groove provided in the outer side of the rotor and catch elements engaging in the groove, the catch elements being connected with flexible bands or cords carrying thread guiding organs arranged at a distance from one another;

(b) the bands or cords are deflected at least about upper deflection pulleys, the thread guiding organs coming to lie on opposite sides of the deflection pulley, and the upper deflection pulley being at the height of the upper running ring; and (c) the distance between the upper and the lower running rings, as well as the maximum distance between the thread guiding elements or organs at the deflected flexible band or cord, are dimensioned such that the shedding angle is sufficiently large to prevent a contact of the warp threads with the shuttle.

By attaching the thread guiding organs to the band, for instance by providing eyes, there is no need to use heddles. The deflection pulley thus may be arranged approximately at the height of the upper running ring. Despite this comparatively low construction height, a sufficiently widely opened shed may be formed. By arranging the thread eyes directly on the bands, the bulk of machine parts moving the warp threads is substantially reduced, which is of significance to the high speed, the quiet running and the noise level of the machine.

According to a preferred embodiment, the flexible band is guided only over an upper deflection pulley and is fastened to the stationary machine frame on an end opposite the catch element by means of a tension spring. According to a further advantageous embodiment the flexible band is formed into an endless loop, running over two deflection pulleys. Suitably, a plurality of flexible bands or cords are connected with one catch element. Advantageously, the shuttle comprises a supporting body carrying running rollers which are fitted between engaging surfaces of the upper and lower running rings, and the running rings accommodate the centrifugal force and supporting forces, and the shuttle is drivable by a catch roller freely rotatably fastened to the rotor. In order to keep the warp threads in a state as tensioned as possible for a good shedding, a thread breakage and overtensioning of a warp thread being noticeable, the tensioning means for the warp threads are designed as leaf springs stationarily fastened to the machine frame on one end and carrying an eye accommodating the warp thread on the other, movable end, the movable part being movable between stops indicating and controlling a thread breakage or overtensioning.

BRIEF DESCRIPTION OF THE DRAWINGS

The invention will now be explained in more detail by way of several embodiments, and with a reference to the accompanying drawings, wherein.

DESCRIPTION OF EXEMPLARY EMBODIMENTS

Figure 1:
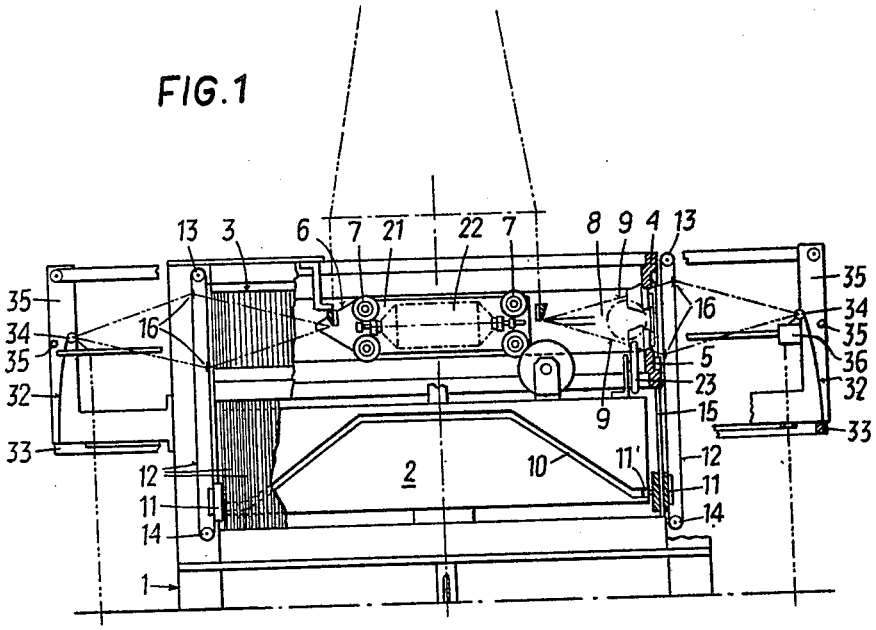
FIG. 1 is a schematic partially sectioned side view of a circular loom in accordance with a first embodiment of the present invention.

With reference first to FIG. 1, a circular loom in accordance with one embodiment of the present invention comprises a drivable rotor 2 rotatably mounted in a machine frame 1 and arranged below a stationary reed 3. The reed is delimited by an upper and a lower running ring 4, 5, respectively, along which at least one shuttle 6 is guided by means of running rollers 7.

For the formation of a shed 8 by the warp threads 9 a harness is arranged in a circle concentric to the rotor 2, which harness comprises a wave-like groove 10 provided in the outer side of the rotor 2 and catch elements 11 engaging in the groove and designed as sliding blocks. In order to minimize the friction between the catch elements 11 and the rotor, the catch elements 11 may comprise rotatable rollers 11' inserted in the groove 10.

Each of the catch elements 11 carries a plurality of flexible bands 12 or cords, which are each guided over an upper 13 and a lower 14 deflection pulley rotatably mounted on the machine frame 1. Each catch element 11, for the purpose of an exactly vertical guidance, is guided along two guide rods 15 arranged parallel and vertical and penetrating the catch element 11, which guide rods are rigidly fastened to the machine frame 1.

Figure 2:
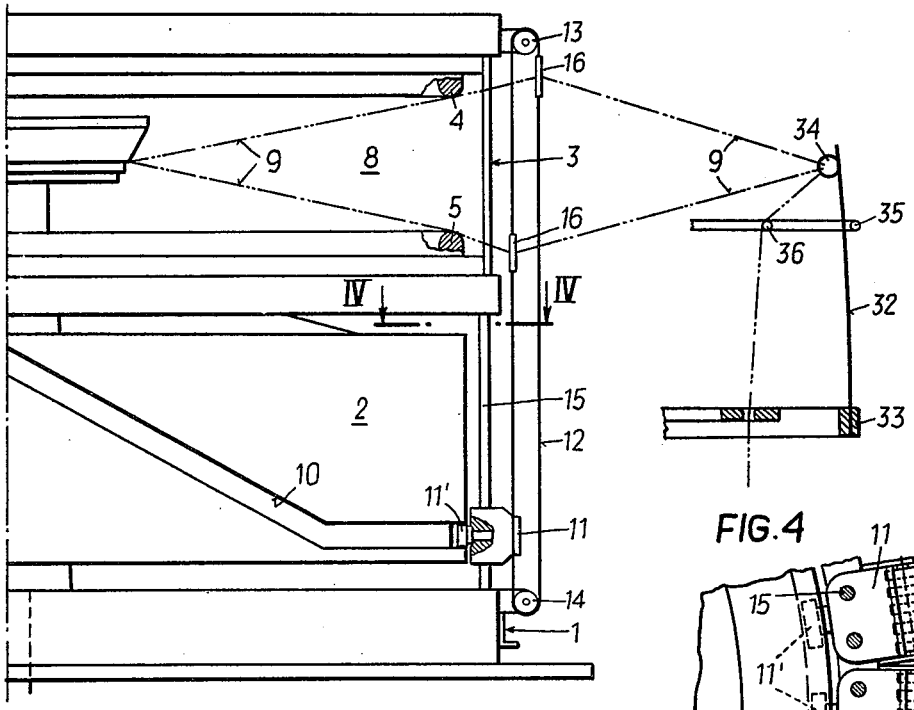
FIG. 2 is a detail of FIG. 1 on an enlarged scale.
Figure 4:
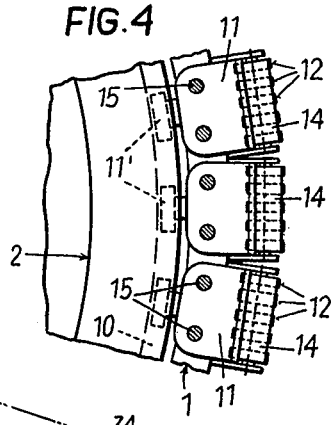
FIG. 4 is a section taken along the line IV—IV of FIG. 2.
Figure 5:
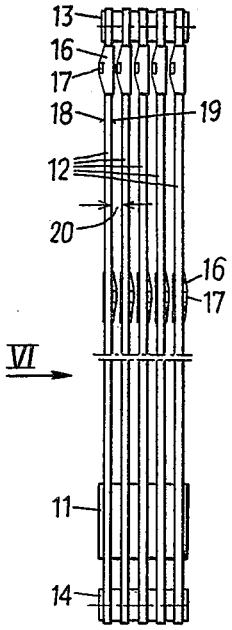
FIGS. 5 and 6 illustrate a flexible band including thread guiding organs, FIG. 6 being a side view taken in the direction of the arrow VI of FIG. 5.
Figure 6:
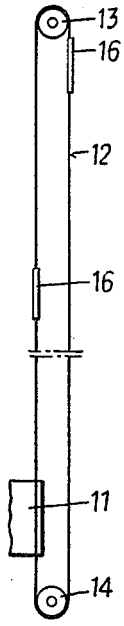
Figure 15:
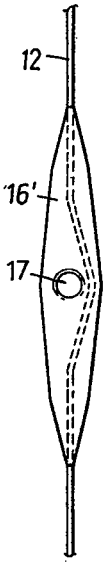
FIGS. 15 and 16 illustrate an alternative embodiment of a thread guiding organ, FIG. 15 being a side view and FIG. 16 being a sectional view taken along the line XVI—XVI of FIG. 15.
Figure 16:
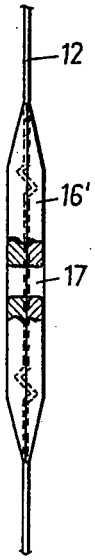

To each band 12 thread guiding organs 16, for instance eyes, are fastened at a distance from one another, the passages 17 of the eyes 16 coming to lie on opposite side edges 18, 19 of each band 12 (cf. FIG. 5) so that the threads 9 can be threaded between neighboring bands fastened to the catch element at a distance 20 from one another. This effect is reached also by using cords in connection with special eyes that are designed in two parts and clippable to the cords (FIGS. 15, 16), by a slanted position of at least one deflection pulley 13, 14. By providing the eyes 16 on the bands, the need for rigid heddles is obviated, thus enabling a low construction height and a compact mode of construction. The distance of the eyes is chosen so large that with a maximally opened shed 8, as is illustrated in FIG. 2, the upper thread 9 contacts the upper running ring 4 and the lower thread 9 contacts the lower running ring 5. Thereby it is possible to move the shuttle 6 through the shed 8 without getting into contact with the warp threads 9.

The shuttle 6 comprises a supporting body 21 carrying the weft thread bobbin 22. The running rollers 7 are guided on the upper and lower running rings 4, 5 of the reed 3, each having a semicircular arc section. The counter sections of the running rollers are adapted to the semicircular arc sections of the running rings 4, 5 and are designed approximately quarter-circular-arc-shaped, extending beyond the vertex of the running ring section so that the running rollers 7 transmit both the centrifugal force and also supporting forces to the running rings, an outward tilting of the shuttle 6 in the idle state thus being prevented.

The drive of the shuttle 6 is effected by means of a catch roller 23 fastened to the rotor 2 in a freely rotatable manner, which contacts one of the running rollers 7 of the shuttle during rotation of the rotor.

Figure 13:
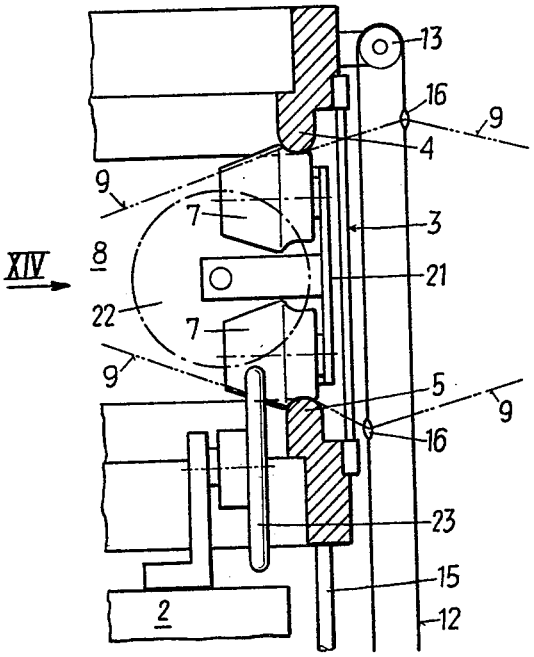
FIGS. 13 and 14 illustrate the guidance of a shuttle, FIG. 14 being a side view taken in the direction of the arrow XIV of FIG. 13.
Figure 14:
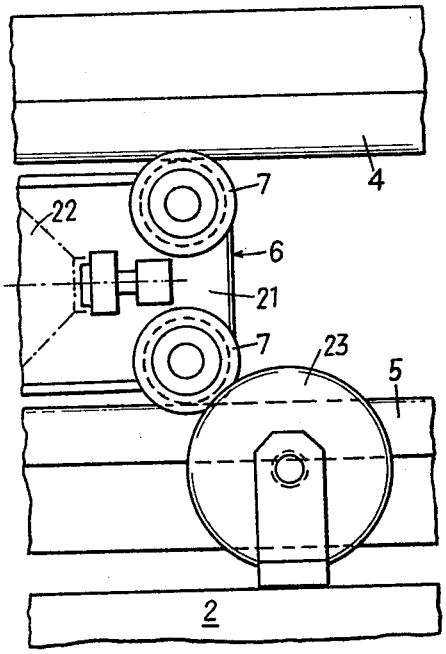

FIG. 13 illustrates the passage of the shuttle 6 through the shed 8. It can be seen that the warp threads 9 are merely overrolled without any sliding movement, the friction between the warp threads 9 and the shuttle 6 as well as the warp threads 9 and the catch roller 23 thus being reduced to a minimum.

Figure 7:
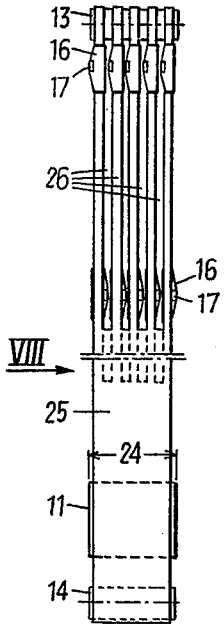
FIGS. 7 and 8, as well as FIGS. 9 and 10, and FIGS. 11 and 12 represent alternative embodiments of flexible bands in illustrations analogous to FIGS. 5 and 6, respectively.
Figure 8:
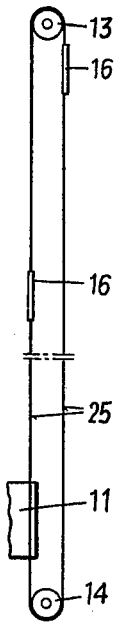

In FIGS. 7 and 8 a modified embodiment of the bands connected with a catch element 11 is shown. With this embodiment a cord 25 whose width corresponds to the width 24 of a catch element 11 is fastened to the catch element, which comprises slots 26 in the region of the shed 8 in order to enable the passage of the warp threads 9.

Figure 3:
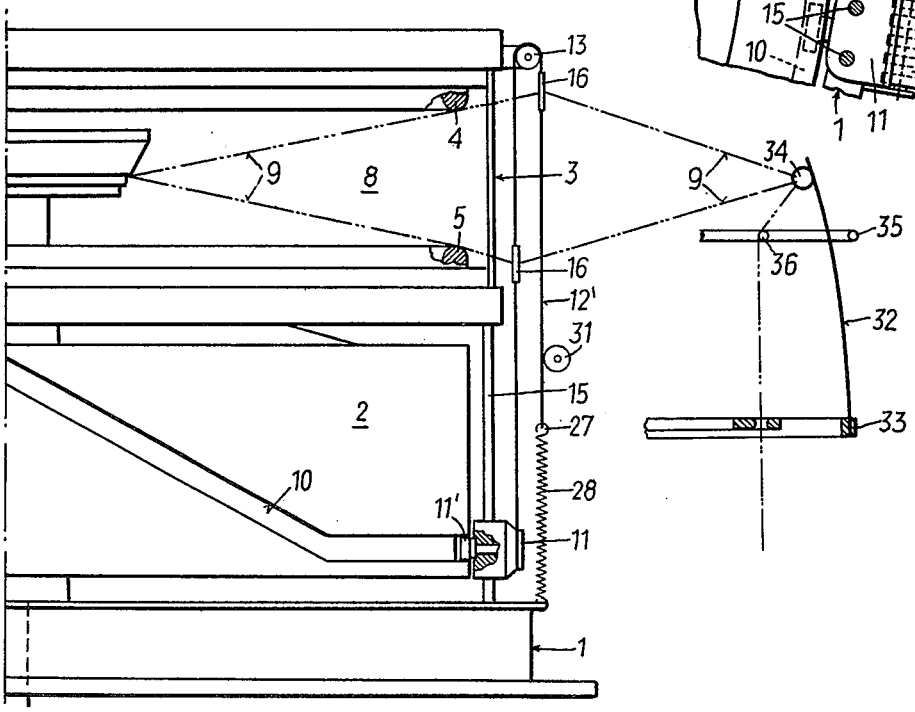
FIG. 3 shows an alternative embodiment in an illustration analogous to FIG. 2.
Figure 9:
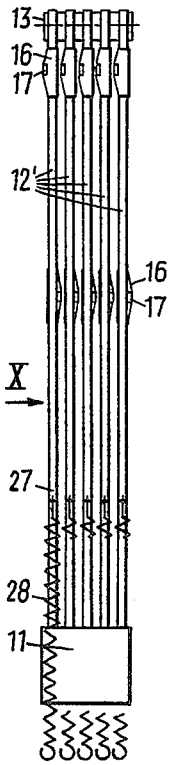
Figure 10:
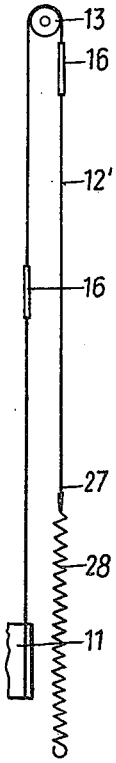

According to the embodiment illustrated in FIGS. 3, 9 and 10, the cords 12 fastened to a catch element 11 are not designed to be endless, but each band 12' is fastened to the machine frame 1, on its end 27 remote from the end connected with the catch element 11, by means of a spring 28. When moving the catch element 11 up and down, the bands 12' are held under tension by the springs 28.

Figure 11:
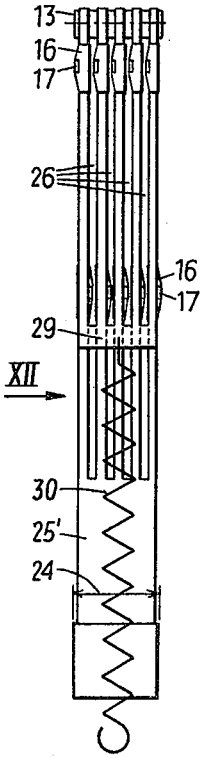
Figure 12:
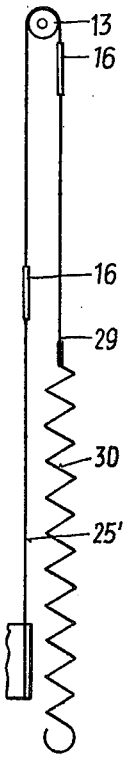

The further embodiment illustrated in FIGS. 11 and 12 also shows a band 25', whose width corresponds to the width 24 of the catch element 11 and which is provided with slots 26 in the region where the eyes 16 are located, through which slots the warp threads 9 can pass. The end 29 of the band opposite the catch element again is designed in one part and fastened to the machine frame 1 by a single spring 30. For a better guidance of the non-endless bands 12' and 25' supporting rollers 31 are rotatably mounted on the machine frame 1 at a height slightly below the lower running ring 5.

The bands 12, 12', 25, 25' may be designed as flat belts, round belts, toothed belts, cords, etc.

The warp threads 9 are tensioned by tensioning means 32, which are designed as leaf springs, to form an optimum shed 8. These leaf springs on one end are fastened to a ring 33 fixedly mounted on the machine frame 1 and on their other end are provided with an eye 34, through which the warp threads 9 are guided. By fore- and backspringing of the leaf springs, the warp threads always remain in an optimally tensioned state. If a warp thread 9 tears, the leaf spring 32 tensioning this thread 9 springs outwardly until it contacts a fixed stop 35, which is designed as a ring concentric to the rotor 2. Thereby a contact is triggered, indicating the tearing of the thread. If the thread tension becomes too strong, the leaf spring 32 springs inwardly until it contacts a stop 36 provided between the leaf spring 32 and the reed 3 and also designed as a ring concentric to the rotor 2, also triggering an indicator.

What we claim is:

1. In a circular loom of the type including a machine frame having an upper running ring and a lower running ring, a reed and at least one shuttle arranged therebetween, a rotor driving said shuttle, a harness arranged in a concentric circle about said rotor and adapted for shedding warp threads, and tensioning means provided for said warp threads, the improvement comprising a wave-like extending groove provided in the outer side of said rotor, catch elements engaging in said groove, flexible means comprising endless loops connected with said catch elements and carrying thread guiding organs arranged at a distance from one another, an upper deflection pulley and a lower deflection pulley for deflecting said endless loops, said upper deflection pulley being located at the height of said upper running ring, said thread guiding organs lying on opposite sides of said upper deflection pulley, and wherein the distance between said upper and said lower running rings as well as the maximum distance between said thread guiding organs on said deflected flexible means are dimensioned such that the shedding angle is sufficiently large so as to prevent a contact of said warp threads with said shuttle.

2. A circular loom as set forth in claim 1, wherein said flexible means is comprised of a flexible band.

3. A circular loom as set forth in claim 1, wherein said flexible means is comprised of a flexible cord.

4. A circular loom as set forth in claim 1, wherein a plurality of flexible means are connected with one catch element.

5. A circular loom as set forth in claim 1, further comprising a supporting body provided on said shuttle and carrying running rollers, said running rollers being fitted in between engaging surfaces of said upper and lower running rings, said upper and lower running rings accommodating the centrifugal force and supporting forces, and a catch roller fastened to said rotor in a freely rotatable manner for driving said shuttle.

6. A circular loom as set forth in claim 5, wherein each of said running rings has an approximately semicircular-arc-shaped section and each of said running rollers of said shuttle has an approximately quarter-circular-arc-shaped counter section corresponding to said semicircular-arc-shaped section, said counter section extending beyond the vertex of said semicircular-arc-shaped section of said running rings.

7. A circular loom as set forth in claim 1, further comprising stops for indicating and controlling a warp thread breakage or a warp thread overtensioning, and wherein said tensioning means for said warp thread is designed as a leaf spring having an end stationarily fastened to said machine frame and a movable end, the movable portion of said leaf spring being movable between said stops, an eye being provided on said movable end for accommodating said warp thread.

8. In a circular loom of the type including a machine frame having an upper running ring and a lower running ring, a reed and at least one shuttle arranged therebetween, a rotor driving said shuttle, a harness arranged in a concentric circle about said rotor and adapted for shedding warp threads, and tensioning means provided for said warp threads, the improvement comprising a wave-like extending groove provided in the outer side of said rotor, catch elements engaging in said groove, flexible means comprising endless loops connected with said catch elements and carrying thread guiding organs arranged at a distance from one another, an upper deflection pulley and a lower deflection pulley for deflecting said endless loops, said upper deflection pulley being located at the height of said upper running ring, said thread guiding organs lying on opposite sides of said upper deflection pulley.

9. In a circular loom of the type including a machine frame having an upper running ring and a lower running ring, a reed and at least one shuttle arranged therebetween, a rotor driving said shuttle, a harness arranged in a concentric circle about said rotor and adapted for shedding warp threads, and tensioning means provided for said warp threads, the improvement comprising catch element guiding means provided on the outer side of said rotor, catch elements engaging in said catch element guiding means, flexible means comprising endless loops connected with said catch elements and carrying thread guiding organs arranged at a distance from one another, an upper deflection pulley and a lower deflection pulley for deflecting said flexible means, said thread guiding organs lying on opposite sides of said upper deflection pulley, and wherein the distance between said upper and said lower running rings as well as the maximum distance between said thread guiding organs on said deflected flexible means are dimensioned such that the shedding angle is sufficiently large so as to prevent a contact of said warp threads with said shuttle.

* * * * *